US010253402B2

(12) United States Patent
Ribes et al.

(10) Patent No.: US 10,253,402 B2
(45) Date of Patent: Apr. 9, 2019

(54) SHEET MADE OF ALUMINUM ALLOY FOR THE STRUCTURE OF A MOTOR VEHICLE BODY

(71) Applicant: CONSTELLIUM NEUF-BRISACH SA, Biesheim (FR)

(72) Inventors: Herve Ribes, Colmar (FR); Gilles Guiglionda, Seyssinet-Pariset (FR); Dominique Daniel, Lans en Vercors (FR)

(73) Assignee: CONSTELLIUM NEUF-BRISACH, Biesheim (FR)

( * ) Notice: Subject to any disclaimer, the term of this patent is extended or adjusted under 35 U.S.C. 154(b) by 449 days.

(21) Appl. No.: 14/903,729

(22) PCT Filed: Jul. 9, 2014

(86) PCT No.: PCT/FR2014/000160

§ 371 (c)(1),
(2) Date: Jan. 8, 2016

(87) PCT Pub. No.: WO2015/004340

PCT Pub. Date: Jan. 15, 2015

(65) Prior Publication Data

US 2016/0168677 A1 Jun. 16, 2016

(30) Foreign Application Priority Data

Jul. 11, 2013 (FR) ..... 13 01644

(51) Int. Cl.
*C22F 1/047* (2006.01)
*C22C 21/00* (2006.01)
(Continued)

(52) U.S. Cl.
CPC ..... *C22F 1/047* (2013.01); *B22D 11/003* (2013.01); *B22D 11/041* (2013.01);
(Continued)

(58) Field of Classification Search
CPC ..... C22C 21/00; C22F 1/047
(Continued)

(56) References Cited

U.S. PATENT DOCUMENTS

2012/0222783 A1 9/2012 Brinkman et al.

FOREIGN PATENT DOCUMENTS

CN 102498229 A 6/2012
JP H036348 A 1/1991
(Continued)

OTHER PUBLICATIONS

"Aluminim 3003-H112 (3003-H16, 3003-H18, 3003-H19 Foil)" MatWeb, Material Property Data, XP002722928 (retrieved Apr. 8, 2014) p. 1-10.

(Continued)

*Primary Examiner* — Weiping Zhu
(74) *Attorney, Agent, or Firm* — McBee Moore Woodward & Vanik IP, LLC; Susan E. Shaw McBee; David Vanik

(57) ABSTRACT

The invention relates to the use of a sheet made of an aluminium alloy for manufacturing a stamped bodywork or structural part of a motor vehicle body, also referred to as a "body in white", wherein said sheet has a yield strength $Rp_{0.2}$ no lower than 60 MPa and a tensile elongation Ag0 no lower than 34%. The invention also relates to a method for making such a stamped bodywork or structural part for a motor vehicle body, made from said sheet and selected in the group including inner panels or linings for car doors, a passenger compartment floor, a boot floor, a spare wheel housing, or even a passenger compartment side.

16 Claims, 2 Drawing Sheets

(51) Int. Cl.

| | |
|---|---|
| ***C22F 1/00*** | (2006.01) |
| ***B22D 11/00*** | (2006.01) |
| ***B22D 11/041*** | (2006.01) |
| ***B22D 21/00*** | (2006.01) |
| ***C21D 1/26*** | (2006.01) |
| ***C22C 21/02*** | (2006.01) |
| ***C22C 21/08*** | (2006.01) |
| ***C22F 1/04*** | (2006.01) |
| ***C22F 1/043*** | (2006.01) |

(52) U.S. Cl.
CPC ..... *B22D 21/007* (2013.01); *C21D 1/26* (2013.01); *C22C 21/00* (2013.01); *C22C 21/02* (2013.01); *C22C 21/08* (2013.01); *C22F 1/00* (2013.01); *C22F 1/04* (2013.01); *C22F 1/043* (2013.01)

(58) Field of Classification Search
USPC ..... 420/532
See application file for complete search history.

(56) References Cited

FOREIGN PATENT DOCUMENTS

| | | |
|---|---|---|
| JP | 2001262263 A | 9/2001 |
| JP | 2001266264 | 9/2001 |
| JP | 4993141 B2 * | 8/2012 |

OTHER PUBLICATIONS

Willan, Craig, "Aluminum Metallurgy" Omega Research, Update Newsletter. XP002722929, (Jan. 29, 2001), vol. 5, p. 1-6.
Murphy, Mike, "Aluminum Growth in Auto Body Today to 2020" ALCOA. XP002722930, (Oct. 24, 2012) p. 1-12.
Das, Sujit, "The Life-Cycle Impacts of Aluminum Body-in-White Automotive Material" JOM. XP002722931, (Aug. 2000) vol. 52, No. 8: 41-44.
"Automotive body sheet specifications product portfolio" Constellium. XP002722932, (Updated Apr. 22, 2013) p. 1-6.
Scamans, Geoff, "Aluminum Structured Vehicles: Myths and Realities" Innoval Technology. XP002722933, (Jun. 15-16, 2005) p. 1-30.
International Search Report from corresponding PCT/FR2014/000160, dated Jan. 10, 2014.

* cited by examiner

SHEET MADE OF ALUMINUM ALLOY FOR THE STRUCTURE OF A MOTOR VEHICLE BODY

CROSS REFERENCE TO RELATED APPLICATIONS

This application is a § 371 National Stage Application of PCT/FR2014/000160, filed 9 Jul. 2014, which claims priority to FR 13/01644, filed 11 Jul. 2013.

BACKGROUND

Field of the Invention

The invention relates to the field of sheets made of an aluminium alloy for manufacturing bodywork or a structural part of a motor vehicle body, also referred to as a "body in white". More specifically, the invention relates to the use of such sheets having excellent drawing formability, thus enabling parts of complex geometry to be produced or requiring deep drawing such as a door liner or a load floor. The sheets used according to the invention are particularly suitable for the production of complex parts designed for rigidity. They also present excellent resistance to filiform corrosion.

Description of Related Art

Unless otherwise stated, all aluminium alloys discussed in the following are designated according to the designations defined by the "Aluminum Association" in the "Registration Record Series" that it publishes regularly.

All the indications concerning the chemical composition of the alloys are expressed as a percentage by weight based on the total weight of the alloy. The definitions of the metallurgical states are indicated in European standard EN 515.

The static tensile mechanical properties, in other words, the ultimate tensile strength $R_m$, the conventional yield stress at 0.2%, the elongation limit $Rp_{0.2}$, and elongation at rupture A %, are determined by a tensile test according to NF EN ISO 6892-1.

SUMMARY

The use of aluminium alloys in the automotive sector is increasing in order to decrease the weight of vehicles and thus reduce fuel consumption and thus decrease greenhouse gas emissions. Aluminium alloy sheets are notably used to produce numerous body-in-white" parts, including skin panels (or exterior body panels) such as front wings, roofs or roof panels, bonnet, boot, or door panels, and the liners or body structural components such as door, bonnet liners, or the load floors (passenger compartment and boot).

If while numerous skin panels are already produced from aluminium alloy sheets, the transposition from steel to aluminium of liners or structural components of complex geometries is more difficult owing to the poorer formability in terms of the stamping of aluminium alloys compared to that of steels. One of the factors limiting deep drawability, notably in the case of aluminium alloy sheets, is the cracking phenomenon starting at the sheet edges.

For large automotive parts of complex geometry, notably having zones requiring deep drawing, it is common to produce shaped blanks provided with more or less circular cut-outs in the blank to facilitate the flow of material from the inside of the blank toward the corners or the deep wells. During stamping, these internal cut-outs are forced to expand and can be the cause of premature failure, for strain levels well under the level given by the Forming Limit Curve (PLC).

There are, however, already automobiles featuring a body in white comprised mainly of aluminium alloys. However, in these cases, the design of said bodies, and notably the layout of parts made of stamped sheets, were designed from the outset by taking the limited formability of aluminium alloys into account.

This is why automobile manufacturers have high levels of demand for aluminium alloy sheets having a markedly improved drawing formability which would greatly facilitate the transposition to aluminium of parts with complex geometry which are currently made of steel. These parts may be transposed from steel to aluminium without it being necessary to completely redesign the layout or the cutting of the component parts.

The costs of developing a new design adapted to aluminium and those associated with the fabrication of specific drawing tools may be significantly reduced.

This is the context of the present invention.

More specifically, the choice of alloys currently available for use as bodywork skins results from a compromise between sometimes conflicting requirements such as: formability, final mechanical strength after paint baking, yield stress during forming, suitability for hemming, surface quality, suitability for assembly, corrosion resistance, cost, recyclability, etc. Faced with such requirements, the alloys of the Al—Mg—Si type are currently selected, i.e. alloys of the AA6xxx series.

Indeed, the alloys of type AA6016, AA6016A, AA6005A, and AA6014, for Eastern Europe, and alloys AA6111 and AA6022 in the United States, are the most commonly used for such applications, in thicknesses in the order of 1 mm, mainly owing to their relatively good formability in terms of stamping and hemming in the T4 "tempered" state, their significant hardening during the baking of paints and their excellent surface appearance after forming. For body structure and lining parts having more complex geometries, for which drawing formability is significant, the alloys of the AA5xxx series (Al—Mg) with a limited magnesium content (typically Mg ≤5%) are currently the most used, mainly because they offer a good compromise between formability in the annealed or O-temper condition, mechanical properties after forming, thermal stability and corrosion resistance in service. The most commonly used are the alloy types AA5182, AA5754, and AA5454.

In addition, for producing parts of complex geometry made of aluminium alloy, notably such as a door liner, not feasible by conventional stamping with the above alloys, various solutions have been considered and/or implemented in the past:

- Circumvent the difficulty associated with drawing by producing this type of part by casting, and notably of the "pressure die-casting" type. Patent EP 1 305 179 B1 by Nothelfer GmbH, under priority application in 2000, reflects this.
- Perform "warm" drawing to benefit from better drawability. This involves heating the aluminium alloy blank, wholly or locally to a so-called intermediate temperature, i.e. from 150° C. to 350° C., in order to improve its behaviour under the press, the tools of which can also be preheated. Patent EP 1 601 478 B1 of the applicant, under priority application in 2003, is based on this solution.
- Modify, via its composition, the drawability of AA5xxx series alloy itself; it was notably proposed to increase the magnesium content in excess of 5%. This has an impact in terms of corrosion resistance.

Use composite sheets consisting of a core made of AA5xxx series alloy, with a Mg content in excess of 5% for improved formability, and cladding sheet made of an alloy with better corrosion resistance. Although the corrosion resistance at the edges of the sheet, in the punched zones or more generally where the core is exposed, and notably in the assemblies, can be insufficient.

And finally, asymmetrical rolling to create a more favourable crystallographic texture was also proposed. This is reflected in patent application JP 2003-305503 by Mitsubishi Aluminium). However, the industrialisation of this type of asymmetric rolling is delicate, requires specific rolling mills, can have an adverse effect on the surface appearance of the sheets produced, and may also generate substantial supplementary costs.

Finally, with regard to the alloys, good drawability is generally the combination of good working ability, or "workability", if possible by may maintaining intermediate deformations in the order of 20%, good ductility and, for parts of complex geometry comprising deeply stamped areas, good "hole expansion" behaviour.

Except for the alloys of the AA1xxx series (low alloy or commercially pure aluminium) having excellent ductility but associated with levels of very low mechanical properties, i.e. typically uniaxial traction elongation of $A_{50}$=43% associated with a conventional yield stress $Rp_{0.2}$ in the order of 28 MPa for a AA1060-O type alloy (as per "Aluminum and Aluminum Alloys—ASM Specialty Handbook, Edited by J. R. Davis (1993), Chapter: Properties of Wrought Aluminum and Aluminum Alloys"), it is difficult to obtain excellent ductility.

The so-called non-heat treatable alloys of the AA3xxx (Al—Mn) or AA1xxx (Al—Mg) or AA8xxx (Al—Fe—Si) series, allow conventional yield stress $Rp_{0.2}$ to he attained that are higher than those of alloys of the AA1xxx series, but at the expense of ductility. Moreover, for most of them, the tensile elongation falls to around 25% as soon as the yield stress $Rp_{0.2}$ exceeds the value by substantially 50 MPa.

Thus, the elongation at break $A_{50}$ of the AA3003 type alloy, which is nevertheless known for its good ductility associated with a yield stress $Rp_{0.2}$ of 40 MPa, sees its elongation $A_{50}$ drop to substantially 25% when magnesium is added to increase the yield stress $Rp_{0.2}$ up to 70 MPa, as appears for the alloy AA3004.

To illustrate this, the table below presents the typical mechanical properties measured in uniaxial tension at ambient temperature according to "*Aluminum and Aluminum Alloys—ASM Specialty Handbook*" published by Davis (19) 3), Chapter: "Properties of Wrought Aluminum and Aluminum Alloys".

| | Alloy | $Rp_{0.2}$ (MPa) | Rm (MPa) | $A_{50}$ (%) |
|---|---|---|---|---|
| ≥99.99% Al | AA1199-O | 10 | 45 | 50 |
| ≥99.6% Al | AA1060-O | 28 | 69 | 43 |
| ≥99.0% Al—0.12Cu | AA1100-O | 34 | 90 | 40 |
| Al—0.8Mg | AA5005-O | 41 | 124 | 25 |
| Al—1.2Mn—0.12Cu | AA3003-O | 42 | 110 | 30-40 |
| 0.55Mn—0.55Mg | AA3105-O | 55 | 115 | 24 |
| Al—1.4Mg | AA5050-O | 55 | 145 | 24 |
| Al—1.2Mn—1.0Mg | AA3004-O | 69 | 180 | 20-25 |
| Al—2.5Mg—0.25Cr | AA5052-O | 90 | 195 | 25 |

-continued

| | Alloy | $Rp_{0.2}$ (MPa) | Rm (MPa) | $A_{50}$ (%) |
|---|---|---|---|---|
| Al—4.5Mg—0.35Mn | AA5182-O | 138 | 276 | 25 |
| 0.8Si—0.6Mg—0.5Mn—0.35Cu | AA6009-T4 | 131 | 234 | 24 |

Problem

The invention aims to achieve this compromise of ductility and optimal yield stress by proposing a sheet made of aluminium alloy for automotive structural components also referred to as "body-in-white" components, having significantly improved formability, stable over time and better than the prior art, and enabling the manufacture of automobile parts of complex geometry by means of conventional drawing at room temperature which would be possible to produce using aluminium alloy sheets currently employed in the field of automotive construction. This sheet must also have a minimum of mechanical strength, as well as very good resistance to corrosion and notably filiform corrosion.

Subject of the Invention

The invention relates to the use of a sheet of aluminium alloy for manufacturing stamped bodywork or a structural part of a motor vehicle body also referred to as "body-in-white" components, characterised in that said sheet has a yield stress $Rp_{0.2}$ greater than or equal to 60 MPa and a tensile elongation under uniaxial tension $A_{80}$ greater than or equal to 34%. Advantageously, said sheet has a hole expansion ratio, known to those skilled in the art as HER (Hole Expansion Ratio), greater than 50 or even greater than or equal to 55.

According to a preferential embodiment, its composition is as follows (as a percentage by weight): Si: 0.15-0.50; Fe: 0.3-0.7; Cu: 0.05-0.10; Mn: 1.0-1.5 or even 1.0-1.2 and more preferably 1.1-1.2; other elements <0.05 each and <0.15 in total, and the rest of aluminium.

According to an even more preferential embodiment, the Fe content is at least 0,3%.

According to another embodiment, the preferred Si content is 0.15 to 0.30%.

The method of manufacturing said sheet preferably comprises the following steps: Continuous or semi-continuous vertical casting of a slab and scalping of said slab, homogenization at a temperature of at least 600° C. for at least 5 hours, preferably at least 6 hours followed by controlled cooling to a temperature of 550 to 450° C., typically 490° C., in at least 7 hours, preferably at least 9 hours, followed by cooling to room temperature in at least 24 hours, advantageously, controlled slow cooling to substantially 150° C. in at least 15 hours, preferably at least 16 hours.

Heating to a temperature of 480° C. to 530° C. with a temperature rise of at least 8 hours, hot rolling, cooling and then cold rolling and annealing at a temperature of at least 350° C., working, typically by stretch flattening or between rollers or by "skin pass", with urate of between 1% and 10%, Chemical pickling of the of the mechanically disturbed layer (MDL), also known as the Beiiby layer. According to a more preferred means of implementation, the aforementioned working rate is between 1% and 5%.

According to an advantageous embodiment, the chemical pickling is performed after alkaline degreasing, in an acid medium with a loss of mass of the sheet of at least 0.2 g/m per side.

Finally, the invention also encompasses stamped bodywork or a structural part of a mc tor vehicle body manufactured by drawing from a sheet having at least one of thc aforementioned properties. It is selected, for example, from the group consisting of door liners or interior panels, passenger compartment floors, boot floors, spare wheel panels or even passenger compartment panels.

DETAILED DESCRIPTION OF A PREFERRED EMBODIMENT

Figure 1:
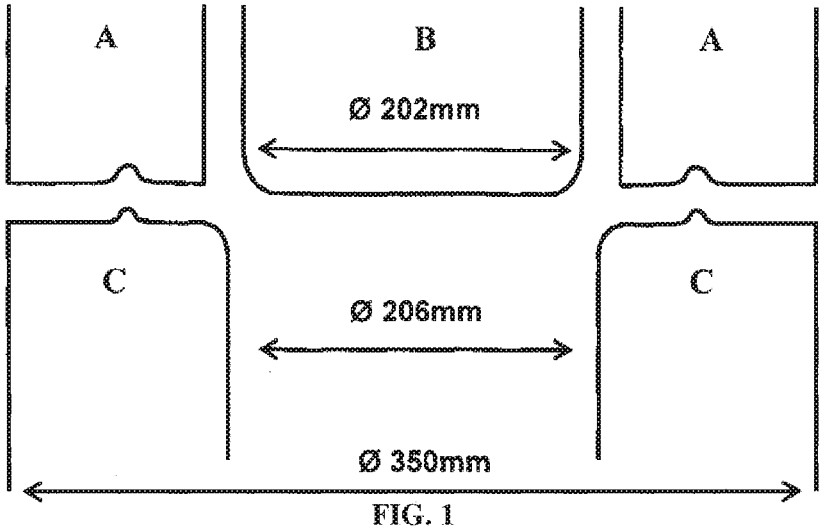
FIG. 1 represents a schematic sectional drawing of the tool used to measure the hole expansion ratio (HER) with A the blankholder, B the punch and C the die.

The invention relies on the finding made by the applicant that it was quite possible to use, for stamped bodywork sheets or motor vehicle body structures referred to as "body-in-white" components, sheets having excellent ductility, notably due to an elongation at rupture $A_{80}$ greater than or equal to typically 34%, and sufficient mechanical strength, notably due to a yield stress $Rp_{02}$ greater than or equal to typically 60 MPa, and very good resistance to filiform corrosion.

Such use was never retained in the automotive sector as those skilled in the art wrongly thought that the level of mechanical properties was insufficient. The applicant discovered that, on the contrary, this combination was perfect for parts designed to be rigid, which is the case for most stamped bodywork sheets or motor vehicle body structures referred to as "body-in -white" components.

Such a use has the advantage of excellent formability, notably in drawing, enabling the production of motor vehicle parts of complex geometry not feasible with the aluminium alloys currently used in the automobile industry. It also authorises the transposition of steel with aluminium by making very few changes in the shape of the tools designed for shaping steels, except those associated with taking into account the greater thickness of the aluminium alloy sheet.

A typical alloy composition for the sheet according to the invention is as follows (as a percentage by weight): Si: 0.15-0.50; Fe: 0.3-0.7 and more preferably 0.5-0.7; Cu: 0.05-0.10; Mn; 1.0-1.5 and more preferably 1.0-1.2 or even 1.1-1.2; other elements <0.05 each and <0.15 in total, and the rest of aluminium.

The concentration ranges imposed on the components of this type of alloy is explained as follows:

Si; the presence of silicium, at a minimum content of 0.15%, considerably accelerates the precipitation kinetics of the manganese in the form of fine and numerous intermetallic particles with a very favourable effect on formability.

Beyond a content of 0.50%, it proves to be detrimental to formability and has a significant influence on the type of iron phases obtained. The most advantageous content range is from 0.15% to 0.30%.

Fe: a minimum content of 0.3%, and more preferably 0.5%, substantially reduces the solubility of manganese in solid solution, which provides a positive strain rate sensitivity, delays rupture during deformation after necking, and therefore improves ductility and formability. Iron is also necessary for the formation of a high density of intermetallic particles ensuring good "workability" during shaping. Beyond a content of 0.7%, too many intermetallic particles are created which has a detrimental effect on ductility and resistance to filiform corrosion.

Cu: at minimum content of 0.05%, its presence in solid solution allows mechanical properties to be obtained without substantial degradation of formability. Beyond 0.1%, the strain rate sensitivity and therefore the formability substantially deteriorated. Furthermore, copper negatively affects the corrosion resistance.

Mn: a minimum content of 1.0% is necessary to achieve the required level of mechanical properties and form enough precipitates providing good "workability".

Beyond 1.5%, an excessive quantity is present in solid solution, which does not favour formability.

The most advantageous content range is from 1.0% to 1.2% or even 1.1% to 1.2%.

Mg: its content is limited to that of an impurity (less than 0.05%). The addition of magnesium my increase the mechanical properties by solid solution strengthening would greatly decrease the strain rate sensitivity and thus ductility.

Zn: in the same manner, its content is limited to that of an impurity (less than 0.05% or even 0.01%) because, like magnesium, by remaining in solid solution, it also would decrease the strain rate sensitivity and thus formability. The limitations are identical in terms of chromium.

The manufacture of sheets for use according to the invention mainly involves casting, typically vertical semi-continuous casting of slabs followed by scalping.

The slabs then undergo homogenization at a temperature of at least 600° C. for at least 5 hours, preferably at least 6 hours followed by controlled cooling to a temperature of 550° C. to 450° C., typically 490° C., in at least 7 hours, preferably at least 9 hours, followed by cooling to room temperature in at least 24 hours, advantageously, controlled slow cooling to substantially 150° C. in at least 15 hours, preferably at least 16 hours. This type of bi-level homogenization, with controlled cooling, allows the manganese to be "expelled" from the solid solution by precipitation, enabling good formability to be obtained owing to:

High sensitivity to the strain rate (owing to the low solute content in the solid solution), Good "workability" associated with the presence of iron and manganese-based (Fe+Mn) fine and numerous intermetallic particles, A final small grain size, associated with the absence of concomitant manganese precipitation with recrystallization during the final annealing, all leading to excellent ductility.

They are then subjected to heating at a temperature of 480° C. to 530° C. with a rise in temperature in at least 8 hours, then hot rolling, cooling, and then cold rolling.

The sheets or coils are then annealed at a temperature of at least 350° C.

The coil or sheet to be used according to the invention is then subjected to working with a permanent set rate between 1 and 10%, and preferably between 1% and 5%. This working may be achieved by rolling at low reduction type "skin pass" rolling, for example, by tension levelling, or between rollers. This working substantially increases the mechanical strength, especially the yield stress, without significant impact on the elongation at break or ductility.

Finally, chemical pickling is carried out. It aims to eliminate mechanically disturbed area resulting from rolling, on the surface of the sheet, and known as MDL (Mechanically Disturbed Layer) or the Beilby layer.

The thickness of this layer depends on the rolling conditions and the thickness reduction undergone by the sheet; etching should therefore be adapted depending on these parameters. In this case, it is preferably selected so that the loss of mass of the sheet in question is at least 0.2 g/m and per side, more preferably 0.3 g/m or even 0.4 g/m$^2$. The examples below show very good results for a value of 0.5 g/m which can thus be an optional minimum. It can be produced either from a coil on a continuous chemical surface treatment line, by spraying or dipping of the unwound coil, or on cut the sheet metal blanks, by immersion in baths.

In practice, the sheet or coil is subjected to a series of treatments comprising at least one etching step and a series of flushes. These are intended to eliminate chemical residues left upon exiting the pickling bath(s).

The details of the invention will be more easily understood with the help of the examples below, which are not, however, restrictive in their scope.

Preamble

Table 1 summarizes the chemical composition in weight percentage (as a percentage by weight) of the alloys used in the tests. They are marked by A. A1, A2, and B under the abbreviation "Compo." in Table 2.

Foundry slabs of the various alloys were obtained by vertical semi-continuous casting.

After scalping, these slabs underwent homogenization heat treatment (marked "Homo." in Table 2).

As shown in Table 2, the slabs of cases 1 to 6 underwent a homogenization treatment at 610° C. consisting of an increase in temperature in 16 hours to 600° C., hold for 8 hours between 600° C. and 610° C., then controlled cooling to 490° C. in 9 hours, and then down to room temperature in approximately one day.

The slabs of cases 7 and 8 underwent a shorter homogenization treatment consisting of a temperature rise to 610° C., without hold, followed by cooling to 530° C. in 5 hours, directly followed by hot rolling.

The slabs of the comparative examples 9 and 10, consisting AA6016 and AA5182 type alloys, underwent conventional homogenization for these types of alloys.

The next hot rolling step takes place first on a reversing rolling mill to a thickness of approximately 40 mm and then on a 4-cage tandem hot rolling mill to a thickness of 3.2 mm. For cases 1 to 6, this hot rolling step is preceded by a heating step which can raise the temperature of the foundry slab from room temperature to the rolling start temperature of 500° C. in 9 hours.

This rolling step is followed by a cold nuUing step which allows 1.15-mm thick sheets to be obtained.

For cases 1 to 8 and for case 10, a final annealing then allows recrystallization of the alloys so as to obtain an O-temper. This annealing was performed in a conveyor furnace for cases 1 to 4 and 6 to 8 and consisted in bringing the metal to a temperature of 410° C. in approximately 10 seconds, then to cool it. For case 5, recrystallization annealing was performed in a static furnace and consisted in bringing the metal to a temperature of 350° C. in 6 hours. For the comparative example 10, the AA5182 type alloy, recrystallization annealing was in a conveyor furnace and consisted in bringing the metal to a temperature of 365° C. in approximately 30, then letting it cool down.

For the comparative example 9, the AA6016 type alloy, cold rolling was also followed by a final heat treatment. This is slightly different and consists of a solution heat-treatment and quenching performed in a conveyor furnace by raising the temperature of the metal to 540° C. in approximately 30 seconds, and quenching.

For cases 2 to 6, chemical pickling of the mechanically disrupted layer after rolling was also performed in a reel on a continuous treatment line. The sheet was also subjected to a series of surface treatments comprising, after alkaline degreasing and rinsing, of a pickling step in sulphuric and hydrofluoric acids. The etching rate, measured by the loss of mass on a test sample immersed in the pickling bath, was 1.2 g/m per side and in 1 minute. In this example, the pickling was performed by spraying on a coil, followed by triple rinsing. The loss of weight following the treatment was 0.5 g/m$^2$ per face and for the cases 2 to 5. For case 6, the pickling was less extensive and the loss of weight was 0.10 g/m$^2$.

Finally, for cases 2 to 6, the sheet was passed into a tension levelling machine, so as lo slightly plastically deform the material between approximately 1 and 5%.

TABLE 1

| Composition | Si | Fe | Cu | Mn | Mg | Cr | Zn | Ti |
|---|---|---|---|---|---|---|---|---|
| A | 0.22 | 0.63 | 0.08 | 1.14 | 0.003 | 0.002 | 0.003 | 0.012 |
| A1 | 0.21 | 0.59 | 0.08 | 1.17 | 0.002 | 0.002 | 0.002 | 0.013 |
| A2 | 0.20 | 0.57 | 0.08 | 1.14 | 0.0046 | 0.001 | 0.002 | 0.012 |
| B | 0.22 | 0.42 | 0.16 | 1.02 | 1.19 | 0.021 | 0.002 | 0.008 |
| 6016 | 1.07 | 0.21 | 0.09 | 0.17 | 0.40 | 0.042 | 0.007 | 0.017 |
| 5182 | 0.12 | 0.29 | 0.06 | 0.32 | 4.73 | 0.030 | 0.008 | 0.014 |

TABLE 2

| | Case | Compo. | Homo. | Pickling | Flattening | $Rp_{0.2}$ (MPa) | $A_{80}$ (%) | HER | LDH (mm) | Filiform corrosion |
|---|---|---|---|---|---|---|---|---|---|---|
| Comparison | 1 | A | 610° + Controlled cooling | no | no | 49 | 37.5 | 68 | 35.7 | Bad |
| Invention | 2 | A | 610° + Controlled cooling | yes | yes | 70 | 37.3 | 63 | 34.7 | Good |
| Invention | 3 | A | 610° + Controlled cooling | yes | yes | 81 | 35.2 | 57 | 34.0 | Good |
| Invention | 4 | A | 610° + Controlled cooling | yes | yes | 84 | 35.6 | 56 | 33.0 | Good |
| Invention | 5 | A1 | 610° + Controlled cooling | yes | yes | 61 | 37.0 | 67 | 34.6 | Good |

TABLE 2-continued

| | Case | Compo. | Homo. | Pickling | Flattening | $Rp_{0.2}$ (MPa) | $A_{80}$ (%) | HER | LDH (mm) | Filiform corrosion |
|---|---|---|---|---|---|---|---|---|---|---|
| Comparison | 6 | A | 610° + Controlled cooling | partial | yes | 94 | 32.8 | 50 | 31.3 | Bad |
| Comparison | 7 | A2 | 610° C. | no | no | 55 | 29.2 | 45 | 28.4 | Bad |
| Comparison | 8 | B | 610° C. | no | no | 67 | 22.0 | 40 | 26.0 | Bad |
| Comparison | 9 | 6016-T4 | — | — | — | 112 | 24.0 | 39 | 26.2 | Bad |
| Comparison | 10 | 5182-O | — | — | — | 146 | 24.2 | 35 | 33.9 | — |

For all of the cases 1 to 10, the formability and filiform corrosion resistance of the sheets obtained were evaluated. These different characteristics and the associated results are detailed below.

Tensile Tests

The tensile tests at room temperature were carried out in accordance with standard NF EN ISO 6892-1 with non-proportional test pieces, with geometry that is widely used for the sheets and corresponding to test piece type 2 of Table B.1 in annexe B of said standard.

These test pieces notably have a width of 20 mm and a calibrated length of 120 mm.

The percentage elongation (A %) after rupture was measured using a strain gauge with an 80 nun base and is thus rioted $A_{80}$ in compliance with this.

As mentioned in the note of paragraph 20.3 of standard ISO 6892-1:2009(F) (page 19), it is important to note that "Comparisons of percentage elongation are possible only when the gauge length or extensometer gauge length, the shape and area of the cross-section are the same or when the coefficient of proportionality (k) is the same."

Notably, it is not possible to compare the percentage elongation values $A_{50}$ measured with an extensometer having a 50 mm gauge length to percentage elongation values $A_{50}$ measured with an extensometer having a 80 mm gauge length. In this specific case, a test piece of the same geometry produced in the same material, the percent elongation value $A_{50}$ will he greater than the percent elongation value $A_{so}$ and given by the relation: $A_{50}=Ag+(A_{80}-Ag)*80/50$ where Ag, in %, is the plastic extension at maximum force, also called "generalized elongation" or "elongation at necking".

The results of these tensile tests in terms of conventional yield strength at 0.2%, $Rp_{0.2}$, et and percentage elongation $A_{80}$, on an initial length Lo between marks of 80 mm, are given in Table 2.

It clearly indicates that cases 2 to 5, corresponding to slabs according to the invention, are the only ones to combine values of elongation at break $A_{80}$ greater than or equal to 34% combined with conventional yield stress values $Rp_{0.2}$ greater than or equal to 60 MPa.

Case 1, corresponding to a sheet not having undergone the flattening step, has a lower $Rp_{0.2}$ value equal to 49 MPa.

Case 7, corresponding to a sheet not having undergone homogenization of the type described in this invention, has a lower elongation at break $A_{so}$ value and less than 34% while the value of $Rp_{0.2}$ is only 55 MPa. Case 8, corresponding to sheet with a composition outside the invention, has considerably lower elongation $A_{80}$.

The sheets of the comparative cases (9 and 1.0), in alloys 6016-T4 and 5182-O habitually used for motor vehicle bodywork panels, also have considerably lower $A_{80}$ values, around 24%.

Measurement of the Hole Expansion Ratio (HER)

As mentioned in the chapter "State of the Art", one of the factors linnting deep drawability is the cracking phenomena from the sheet edges.

In this example, hole expansion tests were performed on a sheet according to the invention in comparison with sheets made of AA5182-O and AA6016-T4 alloys.

The test consists of using a flat-bottom punch of diameter 202 mm (see FIG. 1) to punch a blank with a hole in the centre of diameter 100 mm. Drawing is performed with the blank blocked. The blank is blocked between the die and the blankholder by means of a retaining clamp and a pressure of 13 MPa exerted by the blankholder. The circular hole of 100 mm in diameter is formed at the centre of a circular blank of 350 mm in diameter by water jet cutting. The punch speed is 40 mm/min. The movement of the punch stops when the force on the punch drops 100 daN/0.2 s, which corresponds to the beginning of a crack from the edge of the hole. The test is then ended. The performance of the materials is characterized in this hole expansion test by what is called "the hole expansion ratio" HER defined as HER=(Di-Df)/Di where Di is the initial diameter of the hole in the blank (here 100 mm) and Df is the final diameter of the hole after the test is stopped.

The results obtained in these tests are given in Table 2 in the column marked HER where the hole expansion ratio values are presented. It clearly indicates that cases 2 to 5, corresponding to slabs according to the invention, are the only ones to combine hole expansion ratio values (HER) greater than 50, or even 55, with conventional yield stress values $Rp_{0.2}$ greater than or equal to 60 MPa.

Case 1, corresponding to a sheet not having undergone the flattening step, has an HER value greater than 50, but associated with a low $Rp_{0.2}$ value of 49 MPa. The other comparative. cases (7 to 10) have HER values significantly lower than those of the sheets according to the invention.

Measuring the LDH (Limit Dome Height).

These LDH (Limit Dome Height) measurements were taken to characterize the drawing performance of the various sheets of this example.

The LDH parameter is widely used to evaluate the drawability of sheets of thickness from 0.5 mm to 2 mm. It has been the subject of numerous publications, notably that of R. Thompson, "The LDH test to evaluate sheet metal formability-Final Report of the LDH Committee of the North American Deep Drawing Research Group", SAE conference, Detroit, 1993, SAE Paper No. 930815. It is a drawing test with a blank blocked on the periphery by a retaining clamp. The blank holder pressure is controlled to prevent slippage in the retaining clamp. The blank, with dimensions 120 mm×160 mm, is tested in a mode near the planar strain. The punch used is hemispheric.

Figure 2:
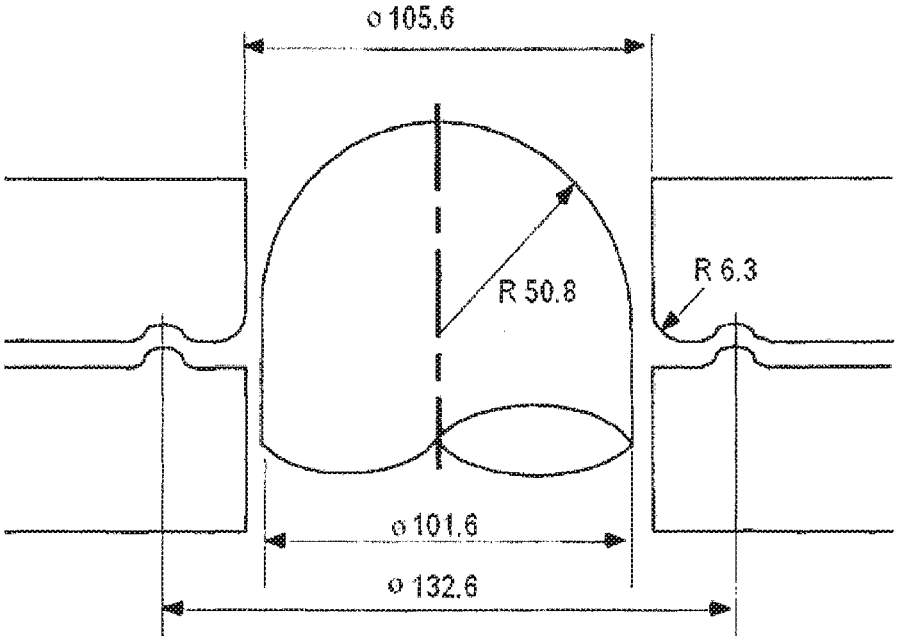
FIG. 2 indicates the dimensions (in mm) of the tools used to determine the value of the parameter known to those skilled in the art as LDH (Limit Dome Height), characteristic of the drawability of the material.
Figure 3:
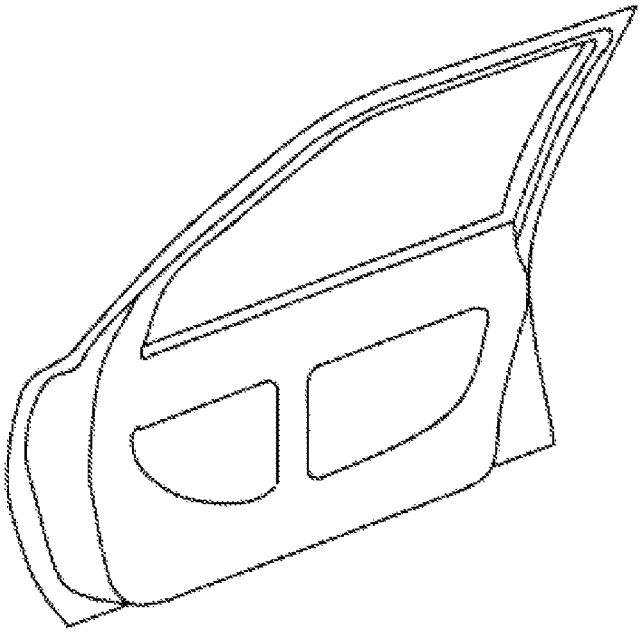
FIG. 3 represents a door structure of a motor vehicle with, in the foreground, the inner panel typically achievable from a sheet according to the invention.

FIG. 2 indicates the dimensions of the tools used to perform this test. Lubrication between the punch and the sheet is provided by graphite grease (Shell HDM2 grease).

The punch is lowered at a speed of 50 mm/min. The LDH value is the actual value of the displacement of the punch at rupture, i.e. the limit drawing depth. It corresponds to the average of three tests, giving a confidence interval of 95% on the measurement of 0.2 mm. Table 2 shows the LDH parameter values obtained on test pieces of 120 mm×160 mm cut from the aforementioned plate and for which the dimension of 160 mm was positioned parallel to the rolling direction.

These results demonstrate that the sheets according to the invention (cases 2 to 5) have high LDH values, greater than or equal to 32 mm. These values are similar or superior to the LDH value obtained for a sheet made of 5182-O alloy (case 10), reference alloy in the case of body panels for severe drawings.

The comparative example (case 1), also has an LDH value greater than 32 mm, but associated with a rather low value of $Rp_{0.2}$ equal to 49 MPa. Conversely, case 6 has a high value of $Rp_{0.2}$, equal to 94 MPa, but associated with an LDH lower than 32 mm.

The comparative examples 7 to 9, corresponding to the sheets not having undergone the homogenization treatment or for which the chemical composition is outside the invention, exhibit LDH values significantly lower than those of the sheets according to the invention.

Evaluation of the Resistance to Filiform Corrosion

The resistance to filiform corrosion was evaluated and compared to that of sheets made of AA6016-T4 type alloy, commonly used in the field of motor vehicle bodywork. For this purpose, test pieces coated with a layer of cataphoresis are used. These test pieces are then scratched, placed in a corrosive atmosphere to initiate corrosion, and then exposed. to controlled temperature and humidity conditions favouring filiform corrosion according to the standard EN 3665. After a period of 1,000 hours of exposure in a climatic chamber at 40±2° C. and 82% ±3% humidity, the amount of filiform corrosion is evaluated according to DIN EN 3665 Method 3.

Three types of surface treatments were performed before cataphoresis: Surface treatment 1: degreasing Surface treatment 2: degreasing+phosphating–Surface treatment 3: degreasing+"Oxsilaer®"

Degreasing is performed by immersion for 10 minutes in a "Almeco" bath with a concentration of 18 to 40 g/l and at 65° C. During this degreasing, the "metal" is etched approximately 0.3 g/m$^2$, i.e. approximately 110 nm.

The phosphate treatment is done by immersion according to the instruction manual of Chemetall "Die Phosphatierung Vorbehandiung als vor der Lackierung" ("Phosphating as preparation for painting"). During the course of this metal etching step is approximately 0.9 g/m$^2$, i.e. approximately 330 nm.

The phosphate-free conversion treatment, by hydrolysis and condensation of polysiloxanes, or Oxsilan® is carried out by dipping in a bath of Oxsilan® MM0705A to 25 g/l with a withdrawal speed of 25 cm/min, which corresponds to a deposit of about 4 mg of Si/m$^2$. During this s(ep, the metal is not etched. The cataphoresis product used is Catho-Guard® 800 by BASF, an epoxy based pairiL The thickness of the layer of cataphoresis targeted is 23 microns; it is obtained by placement in a bath 30° C. for 2 minutes with a voltage of 260 V, followed by baking at 175° C. for 15 minutes.

The filiform corrosion resistance results on the test pieces having undergone the various surface treatment, cataphoresis, and then the test according to NE EN 3665, with an exposure time of 1000 hours in a chamber are summarized in Table 3 below. They are also reported in the last column of Table 2.

Resistance to filiform corrosion is considered good (O index) if there is no etching or if a start of filiform corrosion has occurred in the form of a few filaments and with a length less than 2 mm. Otherwise, resistance to filiform corrosion is considered insufficient (index X).

TABLE 3

| Case | Surface Treatment 1 | Surface Treatment 2 | Surface Treatment 3 |
|---|---|---|---|
| 1 | X | ○ | X |
| 2 | ○ | ○ | ○ |
| 3 | ○ | ○ | ○ |
| 4 | 0 | ○ | ○ |
| 5 | 0 | ○ | ○ |
| 6 | X | ○ | X |
| 7 | X | ○ | X |
| S | X | X | X |
| 9 (AA6016) | X | ○ | X |

It can be seen that all cases tested, with the exception of case 8, exhibit good resistance to filiform corrosion if cataphoresis is preceded by degreasing and a phosphating treatment (surface treatment 2). The less good resistance to filiform corrosion of the case 8, outside the invention, is associated with its highest copper content, In the case of surface treatments 1 and 3, undergoing prior to cataphoresis either degreasing alone or degreasing followed by a chemical conversion treatment replacing phosphating, only cases 2 to 5 according to the invention have good resistance to filiform corrosion and, in any case, better than the reference case made of AA6016 type alloy, with T4 temper, very commonly used in the automobile industry.

The invention claimed is:

1. A sheet of aluminium alloy, comprising a yield strength of $Rp_{0.2}$ greater than or equal to 60 MPa and a tensile elongation under uniaxial tension $A_{80}$ greater than or equal to 34%, wherein the composition of said sheet is as follows (as a percentage by weight):

Si: 0.15-0.30; Fe: 0.3-0.7; Cu: 0.05-0.10; Mn: 1.0-1.5; other elements <0.05 each and <0.15 in total, and the rest of aluminium;

wherein the sheet of aluminium alloy is suitable for manufacturing stamped bodywork or a structural part of a motor vehicle body; and wherein said sheet has a Hole Expansion Ratio, HER, greater than 50.

2. A sheet of aluminium alloy according to claim 1, wherein said Hole Expansion Ratio is greater than or equal to 55.

3. A sheet of aluminium alloy according to claim 1, wherein the Fe content of said sheet is between 0.5% and 0.7%.

4. A sheet of aluminium alloy according to claim 1, wherein the Mn content of said sheet is between 1.0% and 1.2%.

5. The sheet of aluminium alloy according to claim 1, wherein the Mn content of said sheet is between 1.1% and 1.2%.

6. A sheet of aluminium alloy according claim 1, wherein after degreasing treatment alone or followed by phosphate-free conversion by hydrolysis and condensation of polysiloxanes of said sheet, then cataphoresis, filaments formed during a filiform corrosion resistance test according to standard NF EN3665, with a duration of 1000 hours in the chamber have a length of less than 2 mm.

7. The sheet of aluminium alloy according to claim 1, wherein the sheet of aluminium alloy is incorporated into the bodywork of a motor vehicle body or a structural part of a motor vehicle body.

8. The sheet of aluminium alloy according to claim 7, wherein the composition of said sheet consists essentially of (as a percentage by weight): Si: 0.15-0.30; Fe: 0.3-0.7; Cu: 0.05-0.10; Mn: 1.0-1.5; other elements <0.05 each and <0.15 in total, and the rest of aluminium.

9. The sheet of aluminium alloy according to claim 7, wherein the composition of said sheet consists of (as a percentage by weight): Si: 0.15-0.30; Fe: 0.3-0.7; Cu: 0.05-0.10; Mn: 1.0-1.5; other elements <0.05 each and <0.15 in total, and the rest of aluminium.

10. The sheet of aluminum alloy according to claim 7, wherein the stamped bodywork or structural part of a motor vehicle body is selected from the group consisting of door liners or interior panels, passenger compartment floors, boot floors, spare wheel panels, and passenger compartment panels.

11. A method of manufacturing the sheet of aluminium alloy according to claim 1, comprising:

continuous or semi-continuous vertical casting of a slab and scalping of said slab, composed (as a percentage by weight) as follows:

Si: 0.15-0.30; Fe: 0.3-0.7; Cu: 0.05-0.10; Mn: 1.0-1.5; other elements <0.05 each and <0.15 in total, and the rest of aluminium.

homogenizing at a temperature of at least 600° C. for at least 5 hours, followed by controlled cooling to a temperature of 550° C. to 450° C. in at least 7 hours, then cooling to room temperature in at least 24 hours, heating to a temperature of 480° C. to 530° C. with a temperature rise of at least 8 hours, hot rolling, cooling and then cold rolling and annealing at a temperature of a least 350° C., working, optionally by stretch flattening or between rollers or by "skin pass", with a rate of between 1% and 10%, and chemical pickling of the Mechanically Disturbed Layer (MDL), also known as the Beilby layer.

12. The method of manufacturing the sheer of aluminium alloy according to claim 11, wherein the working rate of said sheet is between 1% and 5%.

13. The method of manufacturing the sheet of aluminium alloy according to claim 11, wherein the chemical picking of said sheet is performed, after alkaline degreasing, in an acid medium, with a loss of weight of said sheet of at least 0.2 $g/m^2$ per side.

14. The sheet of aluminium alloy according to claim 11, wherein the chemical pickling of said sheet is performed, after alkaline degreasing, in an acid medium, with a loss of weight of said sheet of at least 0.4 $g/m^2$ per side.

15. A method of manufacturing a stamped bodywork or structural part of a motor vehicle body comprising:

drawing of said sheet of claim 1 to obtain the stamped bodywork or structural part of a motor vehicle body.

16. Stamped bodywork or structural part of a motor vehicle body obtained by stamping or drawing of a sheet according to claim 1.

* * * * *